United States Patent [19]

Barcus et al.

[11] 3,951,031

[45] Apr. 20, 1976

[54] BRIDGE

[76] Inventors: Lester M. Barcus, 252 Tivoli Drive, Long Beach, Calif. 90803; John F. Berry, 3392 St. Albans Drive, Los Alamitos, Calif. 90720

[22] Filed: Dec. 16, 1974

[21] Appl. No.: 533,221

[52] U.S. Cl. ..... 84/307

[51] Int. Cl.[2] ..... G10D 3/04

[58] Field of Search ..... 84/209–215, 84/298–299, 307–309

[56] References Cited

UNITED STATES PATENTS

| | | | |
|---|---|---|---|
| 85,889 | 1/1869 | Barberie | 84/209 |
| 447,689 | 3/1891 | Lenzner | 84/298 |
| 1,353,904 | 9/1920 | Gertz | 84/209 |
| 1,637,787 | 8/1927 | Schmid | 84/309 |
| 3,443,465 | 5/1969 | Kasha | 84/307 |

*Primary Examiner*—Lawrence R. Franklin
*Attorney, Agent, or Firm*—Albert L. Gabriel

[57] ABSTRACT

A bridge for a string instrument such as a guitar is utilized to dampen flexural vibrations transferred to the instrument body while maintaining direct compressional wave coupling from strings to the instrument body.

5 Claims, 4 Drawing Figures

FIG. 1
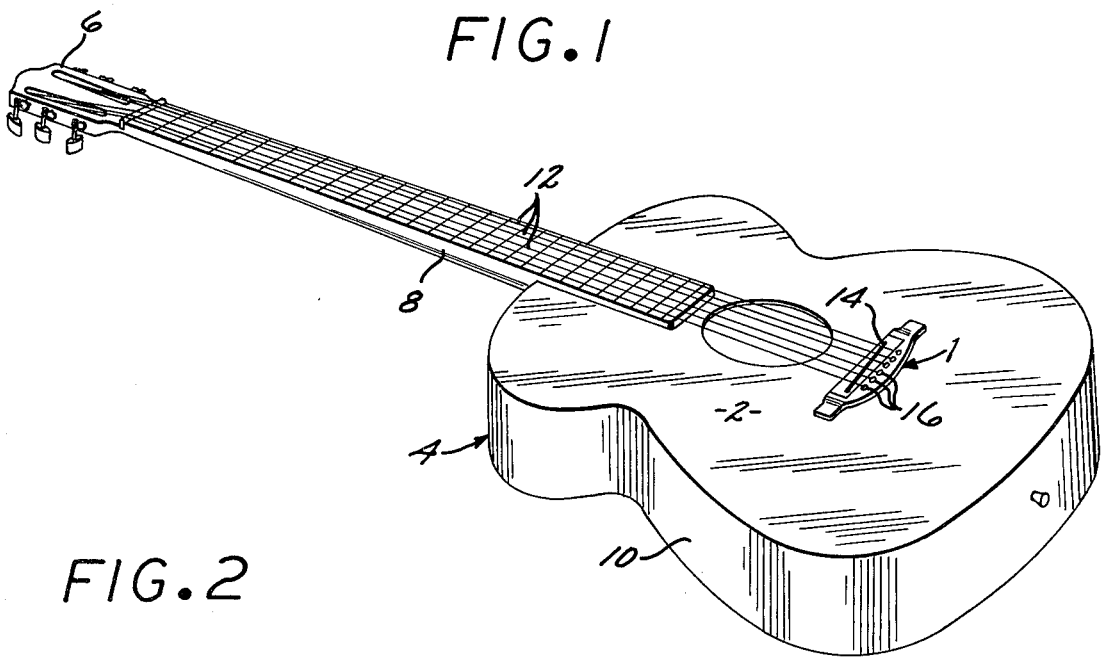
FIG. 2
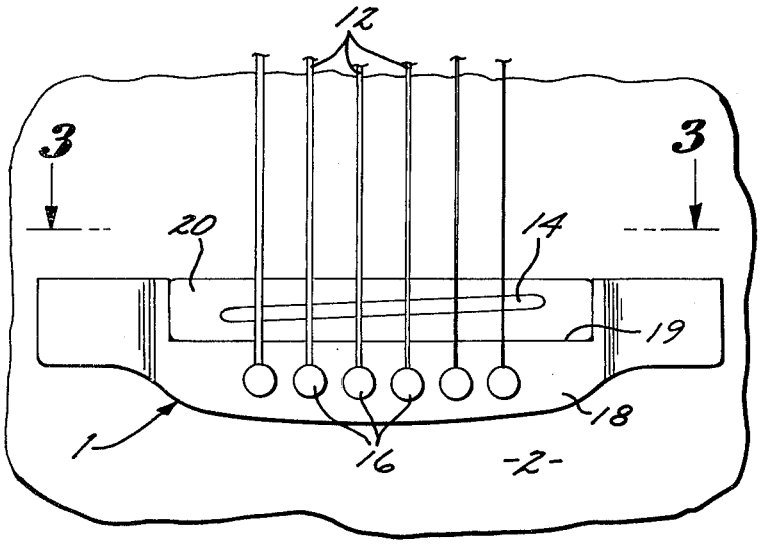
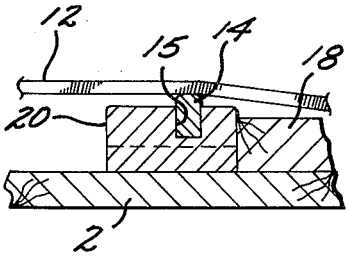
FIG. 3
FIG. 4
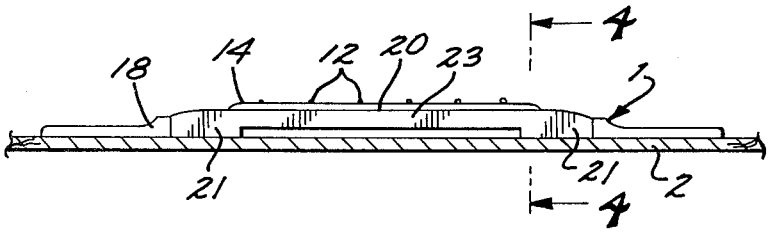

BRIDGE

BACKGROUND OF THE INVENTION

1. Field of the Invention

The invention is in the field of bridges for string musical instruments.

2. Description of the Prior Art

The terms "sonic" and "sound" are used herein to mean the complete spectrum of compression wave frequencies including audio frequencies and frequencies above and below the audio range.

It is traditional for string instruments such as guitars to have wooden bridges which are mounted on the face portion of the guitar and coupled to the strings by means of an ivory, bone or plastic saddle. The saddle was utilized as a string contact member since it was much harder than wood and would consequently last longer under string tension.

As is quite apparent in inexpensive guitars, the decay of a note is not uniform, but rather has an undulating or a decreasing and increasing sound pattern, which sometimes will be referred to as "rollover." Rollover is thought to be associated with a feedback between the guitar body and the strings themselves via the bridge and saddle members. In guitars of excellent or outstanding quality, the design improvements such as discretely formed and positioned wood bracings on the inside of the top plate of the guitar have the effect of reducing the rollover to some extent thereby providing a somewhat more uniform sound decay. However, a significant random, uncontrolled, vibratory feedback from the body to the strings still exists, and an undulating sound decay is still present even in the best quality instruments.

The conventional stringed instrument bridge presents an unstable platform for the strings which tends to vibrate with the strings, thereby having a muting effect on the upper partial frequencies, so that the strings may only vibrate in the fundamental and first few harmonics. Thus, the desired full spectrum of overtone frequencies is never produced in the instrument, and the quality of musical sounds produced by the instrument is seriously limited. This also causes an undesirably large proportion of low frequency sonic energy output of the instrument, with consequently generally poor carrying power.

The feedback of a flexural nature which occurs through the bridge of a guitar or other stringed instrument involves an undesired phase modulation which causes a cancellation effect that is detrimental not only to the dynamic amplitude and frequency, but also to the timbre. Timbre is affected in at least two ways: (1) the sine wave component of the sound is distorted, and (2) the formant of the tone is altered periodically during the decay.

SUMMARY OF THE INVENTION

It is an object of the invention to provide a bridge for a stringed instrument to substantially eliminate such rollover, and thus provide for more uniform sound decay.

It is another object of the invention to prevent vibratory feedback from the body of a musical instrument to the strings by utilizing a special bridge element to decouple the flexural vibrations of the resonant body from the strings.

It is another object of the invention to stabilize the strings of a stringed instrument against the influence of flexural vibrations from the body to allow for a more uniform sound decay.

Another object of the invention is to isolate the top plate of the body of a stringed instrument from gross flexural vibrations of the strings to minimize undesired vibrations in the top plate, while nevertheless effectively transmitting from the strings to the top plate the sonic compressional wave energy which is the musical output of the instrument.

Another object of the invention is to provide an improved transfer medium for coupling sonic energy from the strings to the body of a stringed instrument.

A further object of the invention is to provide a solid, rigid supporting member that presents a stable platform for the strings of a stringed musical instrument, so as to provide a focal point for the accumulation of maximum sonic energy for transmission to the body of the instrument.

A further object of the invention is to provide a massive support for the strings of a stringed instrument to increase the effective sonic energy generated by the strings, and in particular to increase the high frequency content of the sonic energy.

A still further object of the invention is to improve the high frequency response of a stringed musical instrument.

A general object of the invention is to make a better sounding guitar or other stringed instrument that can be produced economically and consistently so that all instruments are generally uniform in musical quality.

The invention utilizes a novel bridge element to essentially isolate the top plate of a musical instrument from gross vibrations of the strings of the instrument and also to essentially isolate the strings from gross flexural vibrations of the top plate of the instrument, while nevertheless serving as an efficient coupler of sonic energy both from the strings to the body for transmission of the musical sounds generated by the strings, and from the body back to the strings to achieve the desired timbre of the instrument. Such isolation of flexural vibrations has been achieved by utilizing a solid, rigid body of substantial inertial mass which has good sonic compressional wave transmission characteristics yet poor resiliency. Lead has been found to be excellent as a bridge element, practically eliminating all rollover. The lead bridge effectively meters out sonic compressional energy from the strings of the body of the musical instrument and back from the body to the strings, but provides vibrational decoupling between the strings and the body preventing the gross flexural vibrations of the strings from being transmitted to the top plate of the instrument, and preventing the gross flexural vibrations of the top plate from being fed back to the strings, thus eliminating rollover and undesired phase modulation.

As a bridge member may be considered a region or channel of compressional energy flow from the strings to the instrument body, a dampening of flexural vibrations in the energy flow channel is much more effective in reducing rollover than prior techniques of relying entirely upon a plurality of wooden braces on the inside of the face of the instrument body. The method of discretely forming and positioning a plurality of wooden braces is cumbersome, time-consuming and expensive as every instrument must be individually and uniquely braced for optimum reduction of rollover.

The method of dampening the flexural vibrations at the bridge is extremely simple and not dependent on the wood properties of the instrument body.

The massive stable support platform provided by the lead bridge element for the strings also materially increases the effective acoustical energy generated by the strings by avoiding the dissipation of energy into useless gross flexural vibrations in the instrument, and this improvement is particularly emphasized in the important high frequency response of the instrument. Thus, the lead bridge element virtually eliminates the muting effect of the conventional vibratory bridge on the upper partial frequencies, permitting the strings to vibrate in all of their natural modes, e.g., even up to many harmonics, generating a full spectrum of overtone frequencies and thereby producing the full, rich timbre of the highest quality instrument even in instruments generally considered to be of average or even poor quality. Because a substantial portion of the energy that would otherwise be in the form of lower frequency energy is thus converted into high energy upper partials which carry better, the overall output of the instrument has substantially greater carrying power.

BRIEF DESCRIPTION OF THE DRAWINGS

These and other objects of the invention will become more apparent in view of the following description wherein:

FIG. 1 is a perspective view of a guitar showing the lead bridge of the invention;

FIG. 2 is a partial plan view of the guitar bridge of FIG. 1;

FIG. 3 is a cross-sectional view of the bridge of the invention taken along lines 3—3 of FIG. 2; and FIG. 4 is a cross-sectional view of the bridge of the invention taken along lines 4—4 of FIG. 3.

As shown in FIG. 1, the bridge 1 of the invention is shown mounted on the top plate 2 of a guitar 4. The guitar is of conventional design having a tuning head 6, neck 8 and sound resonant body section 10. Strings 12 are attached to the tuning head 6 and stretched over a string contact portion or saddle member 14 for connection to anchor pins 16.

As shown more clearly in FIGS. 2–4, the bridge of the invention comprises a base portion or base member 18 which is usually made of wood, a decoupling means 20 and the saddle member 14. The anchor pins 16 are secured to the base member 18 in the traditional fashion, and the base member 18 is secured to the top plate of the guitar by means of adhesive.

In practice, the entire base member 18 is of conventional design, and an insert 19 is cut into the base member so that decoupling means 20 may be inserted therein. The decoupling means 20 is held in contact with the top plate 2 of the guitar 4 by means of the normal tension forces transferred from the strings through the saddle member 14, and may if desired be secured in position on top plate 2 by adhesive or other mechanical fastening means. The decoupling means 20 is preferably of bridge-like construction, having feet 21 proximate its ends which contact the top plate 2 and an intermediate web portion 23 spaced from top plate 2, as seen in FIG. 3.

The decoupling means 20 is preferably made of lead or an alloy consisting primarily of lead, as lead provides a low impedance path for direct compressional energy transfer while at the same time is of poor resiliency and high density so as to dampen the transfer in both directions of flexural vibrations between the strings and the top plate of the instrument. The lead provides a low impedance sonic compressional energy wave path and a high impedance flexural vibration energy path. The exact composition of the lead decoupling means 20 is not critical, and various lead alloys may be used. Thus, in prototype applications alloys of lead have been employed with satisfactory results with up to about 5 percent antimony added which appears to improve the hardness and workability of the lead.

The high density of the lead decoupling means 20 enables it to be compact, fitting generally within the confines of the base member 18, while nevertheless having the inertial mass to provide the desired stable support platform for the strings. Although the exact mass of the lead decoupling means is not critical, in a prototype of the invention a lead decoupling means 20 of approximately 6 oz. was found to be satisfactory.

The decoupling means 20 extends beyond the ends of the saddle member 14. The saddle member 14 may be of any material of suitable hardness and strength to withstand the forces of the strings and to provide a rigid support for the strings at their contact points. For example, in a prototype of the invention a steel saddle member 14 was found to provide a satisfactory support for the strings, while having the added advantage of providing a good impedance match in a guitar having steel strings. The saddle member 14 may be molded in, force-fitted, or otherwise bonded by any desired means into position in the mating groove 15 in the decoupling means 20.

In operation, the saddle member 14 provides a low impedance coupling of the sonic compressional energy of the strings directly to the decoupling means 20. The properties of the decoupling means, such as lead, act to dampen any of the gross lateral motion of the strings (the traditional flexural vibratory motion), and also gross vibratory motions of the top plate, but are greatly effective in transmitting the sonic compressional energy from the strings to the top plate of the guitar itself, as well as transmitting some desirable feedback sonic compressional energy from the top plate to the strings.

While the invention has been particularly shown and described with reference to a preferred embodiment thereof, it will be understood by those skilled in the art that various changes in form and details may be made therein without departing from the spirit and scope of the invention.

We claim:

1. For use in a musical instrument of the guitar-type having strings and a sound resonant body, a bridge comprising:

an upper saddle member in contact with said strings, a lower decoupling member for damping flexural vibration transmissions between the strings and the resonant body but transmitting sonic compressional wave energy, said decoupling member having an upper portion in contact with said saddle member and a lower portion in contact with said resonant body, substantially all of said upper and lower portions of said decoupling member forming an integrally, continuous body comprising primarily lead.

2. Apparatus as recited in claim 1 wherein said decoupling member is generally U-shaped having foot portions in contact with the guitar.

3. Apparatus as recited in claim 1 wherein said bridge further comprises a base portion adjacent said decoupling member for securing the instrument strings.

4. Apparatus as recited in claim 3 wherein said base portion comprises wood.

5. Apparatus as recited in claim 1 wherein said saddle member comprises steel.

* * * * *